United States Patent [19]

Klöckner et al.

[11] Patent Number: 4,736,605

[45] Date of Patent: Apr. 12, 1988

[54] DEVICE FOR CONTROLLING THE LIFTING AND PRESSURE MOVEMENTS OF STRIP PRESSURE ROLLS FOR HOT ROLLED STRIP COILERS

[75] Inventors: Jürgen Klöckner, Nethpen; Dieter Rosenthal, Niederfischbach, both of Fed. Rep. of Germany

[73] Assignee: SMS Schloemann-Siemag Aktiengesellschaft, Dusseldorf, Fed. Rep. of Germany

[21] Appl. No.: 930,546

[22] Filed: Nov. 12, 1986

[30] Foreign Application Priority Data

Nov. 11, 1985 [DE] Fed. Rep. of Germany ..... 3539900

[51] Int. Cl.[4] ..... B21C 47/04

[52] U.S. Cl. ..... 72/21; 72/148; 242/78.1

[58] Field of Search ..... 72/14, 15, 21, 22, 28, 72/31, 146, 148, 371; 242/78.1, 78.3

[56] References Cited

U.S. PATENT DOCUMENTS 3,028,114 4/1962 Asbeck ..... 72/148 X 4,380,164 4/1983 Kuwano ..... 72/148 X

*Primary Examiner*—E. Michael Combs

*Attorney, Agent, or Firm*—Karl F. Ross; Herbert Dubno

[57] ABSTRACT

The device serves to control the desired lifting and pressure-containing movements of strip pressure rolls for the reels which serve to store hot rolled strip. These reels have a rotating mandrel. The pressure rolls are actuated by piston and cylinder units for positioning the rolls electro-hydraulically in conformity with signals which indicate the relative position of the leading strip edge which rotates with the mandrel. The positioning of the roll, by the lifting and pressure-contacting movements, is effectd by position control with subordinated pressure control in a closed-circuit position control loop and a closed-circuit pressure control loop, by input of a setpoint position value which corresponds to the respectively prevailing pressure-contacting and lifting position of the pressure rolls, and by establishment of limited setpoint pressure values for both functions or directions of movement.

4 Claims, 2 Drawing Sheets

DEVICE FOR CONTROLLING THE LIFTING AND PRESSURE MOVEMENTS OF STRIP PRESSURE ROLLS FOR HOT ROLLED STRIP COILERS

FIELD OF THE INVENTION

Our present invention relates to a device for controlling the lifting and pressure movements of auxiliary strip pressure rolls for the coilers which serve to coil hot rolled strip.

BACKGROUND OF THE INVENTION

Coilers having a rotating mandrel require control of the pressing roller in response to signals which are generated in conjunction with the respective position of the forward or leading strip edge of the rolled strip which rotates with the mandrel.

The control function is carried out by electro-hydraulic positioning piston-and-cylinder units which actuate the auxiliary strip pressure rolls with concurrent regulation of the operating force and position.

The aim of control devices for this purpose is to overcome problems which arise during coiling of the initial layers or turns of rolled strip on the mandrel. In particular those problems result because the leading edge of the strip can cause a radial step, or hump or similar projection. This projection affects the subsequently wound strip turns due to the high pressure which is exerted by the pressure rolls on the strip layers by causing shock or dynamic stresses between the coil and the pressure rolls. Such extensive damage may be caused to the first few turns of the coil that they are so severely marked as to require these portions of the strip to be treated as scrap material.

The control device which has been described in German Patent Publication DE-AS No. 2,158,721 operates in such a way that the pressure rolls are temporarily lifted during the strip winding or coiling. Lifting is done by a distance equal to the thickness of the strip, i.e. the height of the radial hump which is caused by the leading edge of the strip, when this hump passes the pressure roll.

The lifting motion is controlled by a pulse generator which is coupled to the coiler mandrel, and the pulse generator feeds a pulse counter which produces signals, by way of a control logic, for the control device. In response to the signals, the control device actuates the piston and cylinder units connected at the pressure roll when the radial rise passes this roll.

In a further known device of this type, the path of the leading edge of the strip accumulating on the coiler mandrel is monitored during formation of the first strip winding by way of contactless sensors, and the path is further monitored and recorded by means of electronic recorders. The positioning of the rolls is then controlled by means of the recorded information using interpreter-/evaluating devices.

In the two prior art devices, the up and down motions of the control elements for the piston and cylinder units, which effect the lifting and contacting movements of the pressure rolls, are controlled by two independent electro-hydraulic control circuits or loops, namely, a position control loop, and a pressure control loop.

The lifting movement of the pressure roll is then effected and controlled by utilization of the corresponding position value in the position control loop. The contacting movement and the subsequent pressing of the roller against the strip is correspondingly effected by input and utilization of a setpoint pressure value in the pressure control loop. The pressure control loop is open when position control is effected.

The prior art devices, accordingly, have the drawback that they require constant and very rapid switching between position control and pressure control. Furthermore, this type of control causes rocking or jerking (hunting) of the system, and the dynamic behavior of the elements which take part in the operation is detrimentally affected. During position control a further problem arises in the case of the known devices in that either no signal may be generated for the respective control device, or only incorrect position signals may be generated. In such an event, the respective piston and cylinder unit will not change its position, and it will not carry out the required movement to avoid an impact against the oncoming rise, for example. Accordingly, additional overload safety equipment must be employed.

OBJECTS OF THE INVENTION

It is therefore the principal object of our present invention to provide a device for controlling the lifting and contacting movements of strip pressure rolls for the storage coilers for hot rolled strip and the like in which the mentioned disadvantages of the prior art do not arise.

It is also an object of the present invention to provide a control device for the purpose described which does not require additional safety equipment.

SUMMARY OF THE INVENTION

The foregoing and other objects and advantages of the invention are obtained in that the respective positioning for the desired lifting and pressure-contacting movements is effected by (a) position control with subordinated pressure control using a closed-circuit position control loop and a closed-circuit pressure or force control loop, (b) by input of a setpoint position value which corresponds to the respectively prevailing pressure-contacting position and the lifting position of the ressure rolls, and (c) by establishing limited setpoint pressure values applicable for both directions of movement.

The invention also contemplates that the setpoint pressure value for the lifting movement has an upper limit which is equal to the maximum value which can be selected in the pressure or force control loop for applying the pressure roll against the coil.

In accordance with the invention, it is also contemplated that a rate limiter follows the pressure controller in the pressure or force control loop.

With this control device there is achieved—in contrast to the prior art devices—the direction or function reversal, from the contacting movement to the lifting movement and vice versa, by controlled input of different setpoint position values, and not by the respective switching between position control and pressure control.

In accordance with a further feature of the invention, when the pressure limiting value is at the maximum, the lifting or pressure roll release movement can also be done with its highest possible velocity. The constant subordinated pressure control improves the dynamic behavior of the components which participate in the movements. Switching-related shocks can not arise because both control loops are constantly closed, or are operated in the closed-circuit mode. In the absence of signals or in the event of incorrect signals, the control system reacts in the manner of a failsafe system because the subordinated pressure control loop per se controls the actual pressure value to the selected limiting setpoint value.

Because the control system is effective in the manner of a system with overload protection, there is no need for the individual piston and cylinder units to be equipped with special overload protection, such as for example, pneumatic support cylinders.

It has also been necessary in the prior art devices to provide a separate support beam which is swingable with respect to a separate support carrier which, in turn, performs the actual lifting and contacting movements as well as being elastically supported with respect thereto. Thus, a further advantage of the invention is that the heretofore necessary support system for the rolls in a separate support beam is not necessary because the control device of the present invention does not require such a resilient support.

BRIEF DESCRIPTION OF THE DRAWING

The above and other objects, features and advantages of our invention will become more readily apparent from the following description, reference being made to the accompanying drawing, in which.

SPECIFIC DESCRIPTION

Figure 1:
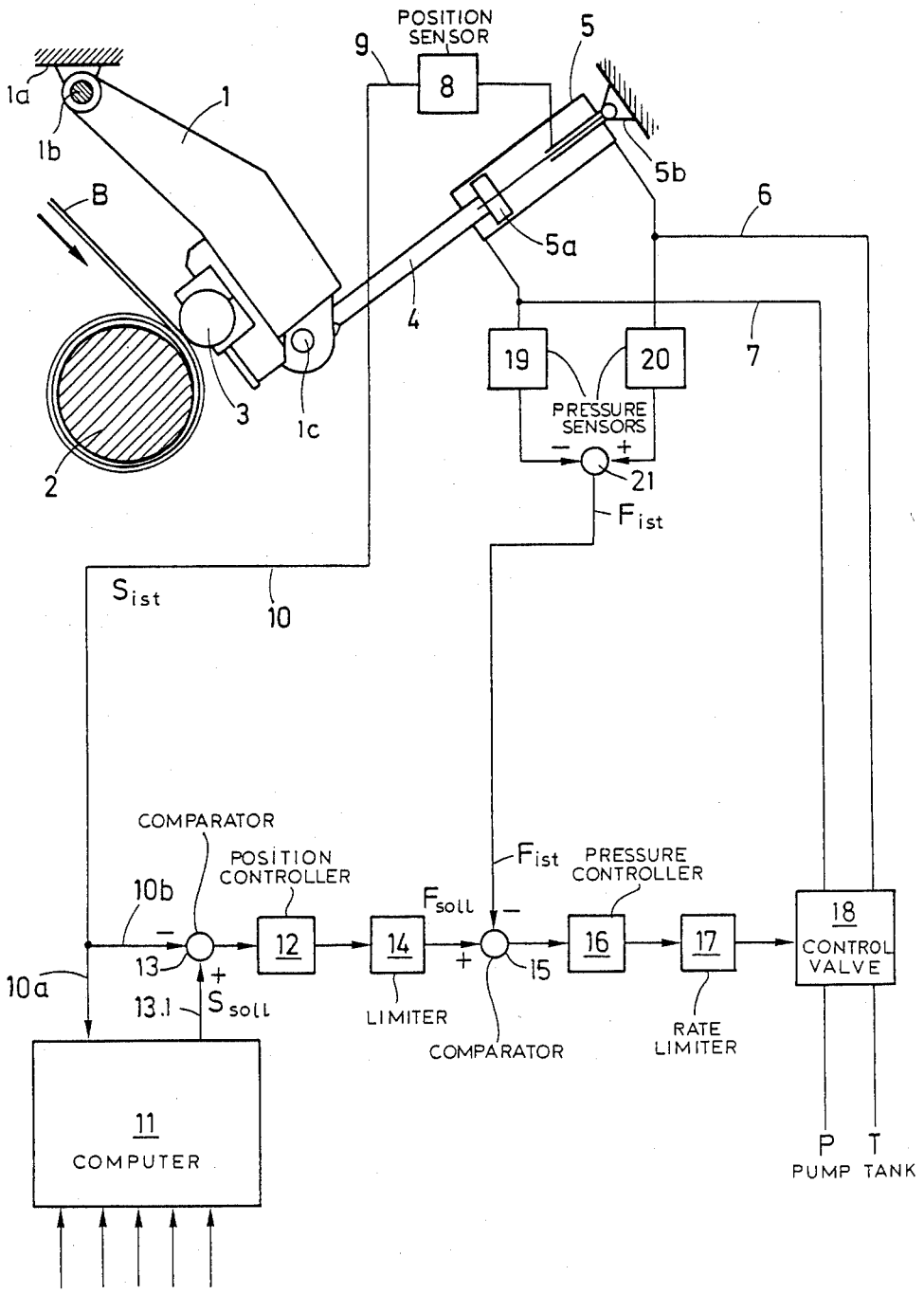
FIG. 1 is a schematic representation of the actuating components of the device and the associated circuitry.

With reference to FIG. 1, for the purpose of clarity, only a single pressure roll 3, is shown for a coiler mandrel generally designated by the reference numeral 2. The coiler 2 serves to coil hot rolled strip B, or the like. The coiler details are not shown since it is known in the art. The pressure roll 3 is supported and journaled in the carrier 1.

The carrier 1 is pivotally linked at a base 1*a* and can be swung or rotated with respect to the pivot shaft 1*b*. A piston and cylinder unit, generally identified by reference numeral 5, is connected at the lower end of the carrier 1, for example by a pivot shaft 1*c*.

The unit 5 includes the piston rod 4 whose inner end carries the piston 5*a*.

The unit 5 is connected to a source of hydraulic medium by hydraulic conduits 6 and 7, respectively, with the flow of the hydraulic medium being regulated by the control valve 18. The double-acting piston 5*a* can be subjected to the force of the hydraulic medium passing through hydraulic conduit 7 or hydraulic conduit 6 to respectively retract and extend the piston rod 4. Movement of the piston rod 4 will correspondingly actuate the carrier 1 and the pressure roll 3. The unit 5 is pivotally arranged with its foot end at a base 5*b*.

In general terms, extending the piston rod 4 will cause pressure-contacting movement of the pressure roll 3 on the strip B. Conversely, retraction of the piston rod 4 will effect the lifting movement or pressure-release of a pressure roll 3 depending upon the extent or retraction.

A sensor 8 is provided at the unit 5 which serves to pick up the movements of the piston rod 4 and, more particularly, the actual position of the pressure roll 3. The corresponding signal indicative of the actual position is designated by $S_{ist}$ in FIG. 1 at conduit 10.

The output side 9 of the sensor 8 is connected to the computing system 11 and a position controller 12 by way of the signal line 10 and its branches 10*a* and 10*b*. The position controller 12, in turn, is connected to the computing system 11 by means of the signal line 13.1.

Through the signal line 13.1 the computing system 11 supplies setpoint position values, designated by $S_{soll}$ for an outer position control loop formed by the sensor 8, lines 10, 101, comparator 13, controller 12 and limiter 14. The setpoint values are compared with the actual position values in comparator 13.

The position controller 12 is followed by a limiter 14 for the setpoint pressure values, and this limiter 14 is capable of acting with respect to both movement directions. The limiter 14 serves to set a maximum setpoint value for the pressure setpoint delivered to comparator 15. The output side of the limiter 14 provides the setpoint pressure values $F_{soll}$ for the inner pressure control loop formed by the sensors 19, 12, the comparator 21, the pressure controller 16 and the rate limiter 17.

The actual pressure value $F_{ist}$ is determined, in turn, by means of the pressure outputs 19 and 20 in the comparator 21 (providing an actual pressure value of correct sign) for utilization in the comparator 15 supplied with the setpoint value $F_{soll}$.

The pressure controller 16 is followed by a rate limiter 17 and it receives as its input the difference provided by comparator 15 between the actual pressure value $F_{ist}$ and the setpoint pressure value $F_{soll}$ as input. Furthermore, the pressure controller 16 controls the valve 18. The rate limiter prevents excessive speed of movement of the valve 18 and hence of the piston 4.

The actual pressure value $F_{ist}$ is always controlled in response to the setpoint pressure value $F_{soll}$ that is provided by the outer position control loop. The two control loops or circuits are both of the closed loop type.

Figure 2:
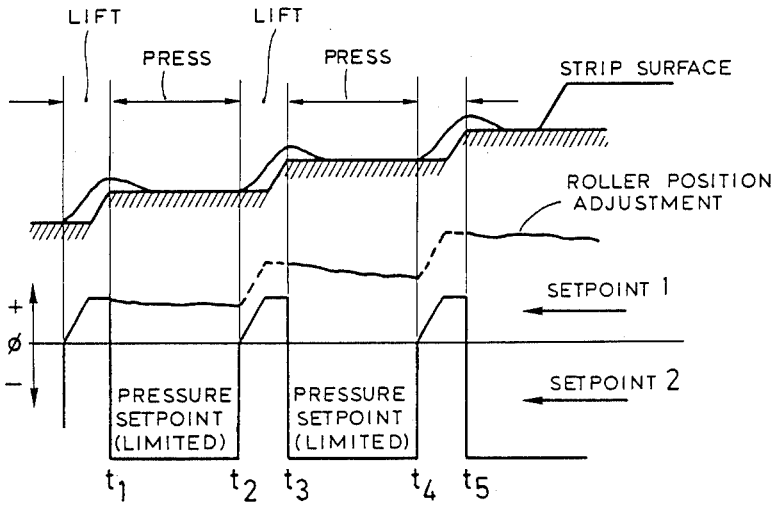
FIG. 2 is a diagram of the control steps.

FIG. 2 schematically indicates the two states of greatest interest, that is (a) the lifting movement, for the rapid retraction or release of the pressure roll 3 by the distance of the radial projection of the growing coil of strip, prior to this radial projection or hump reaching the roll 3, as well as (b) the subsequent pressure-contacting of the roll 3 at the strip when the radial projection has passed. FIG. 2 also indicates that these two movements or functions are achieved by position control with subordinated pressure control, i.e. the position control overrides the pressure setpoint to effect movement of the pressure roll.

The position control loop is initially fed with the setpoint value 1, which is a function of the thickness of the strip B and the kinematics of the pressure roll system.

When the leading edge of the strip has passed the pressure roll at time $t_1$, the setpoint pressure value is changed to level 2 thereby causing the direction of movement of the piston 4 to be reversed and, consequently, the pressure roll 3 to contact the strip B at coiling pressure (pressure contact in FIG.2).

The strip B is thus pressed in the direction of the mandrel 2 with a defined force and the magnitude of this force can be selected in conjunction with the respective dimensions and the strength properties of the respective strip B.

At time $t_2$ the setpoint position value is changed upon arrival of the bending edge at the pressure roll and the next lifting movement is initiated. The setpoint is increased by the computer 11 at the comparator 13 and the increased error output thereof is delivered by the controller 12 through the limiter 14 to the comparator 15. Since the latter comparator now sees a deviation from the new setpoint requiring a lifting of the pressure roll, such lifting is initiated.

The further adjustments at time $t_3$, $t_4$, and $t_5$ are done in analogous fashion.

The further necessary motions, for example, swinging-away of the pressure roll 3 after the first turns have been coiled on the mandrel 2, into the final position, and the bringing of the pressure rolls 3 into a preparatory position in accordance with the expected production diameter of the coil, expected prior to introduction of the strip end, are also done by the position control loop as described by way of the control valve 18.

We claim:

1. A method of controlling the winding of metal strip on a mandrel having at least one pressure roll provided with a hydraulically controlled cylinder unit and adapted to press successive windings against said mandrel and to be lifted upon the approach of a leading edge of the strip to said pressure roll, said method comprising the steps of:

(a) measuring a hydraulic pressure at said cylinder unit and controlling said unit in response thereto in a closed pressure-control loop by:

($a_1$) comparing the measured hydraulic pressure with a setpoint pressure value, and ($a_2$) generating an output representing the comparison in step ($a_1$) and controlling a servovalve with said output to regulate the hydraulic pressurization of said cylinder unit;

(b) measuring the position of said pressure roll and controlling said unit in response to the measurement of position in a closed position-control loop by:

($b_1$) comparing the measured position of said pressure roll with a setpoint position value, and ($b_2$) generating an output representing the comparison in step ($b_1$) and forming said setpoint pressure value with the output representing the comparison in step ($b_1$) therewith; and (c) varying the setpoint position value in step ($b_1$) between two levels respectively corresponding to a lifting of said pressure roll away from said coil and to the application of coiling pressure by said roll to said coil in accordance with the position of said edge relative to said roll to prevent damage to the strip by the application of roll pressure in a region of said edge.

2. An apparatus for controlling the winding of metal strip on a mandrel having at least one pressure roll provided with a hydraulically controlled cylinder unit and adapted to press successive windings against said mandrel and to be lifted upon the approach of a leading edge of the strip to said pressure roll, said apparatus comprising:

a control valve connected to said hydraulically controlled cylinder unit for regulating pressure generated thereby of said pressure roll against said windings and for controlling the position of said pressure roll;

a pressure sensor responsive to hydraulic pressure at said cylinder unit for generating an actual value pressure signal and a first comparator receiving said actual value pressure signal and a setpoint pressure value for producing an output by comparison of said signal and said value;

a pressure controller connected to said first comparator and receiving said output and being connected with said valve for controlling same to establish the actual pressure in said unit in correspondence with the setpoint value supplied to said first comparator;

a position sensor responsive to the position of said pressure roll for generating an actual value position signal;

a second comparaor receiving said actual value position signal and having a output resulting from a comparison with said actual value position signal;

a position controller connected to said second comparator and receiving the output of said second comparator for generating said setpoint value, said position controller being connected to said first comparator for applying said setpoint value thereto; and means connected to said second comparator for applying thereto selectively in accordance with the position of said leading edge relative to said pressure roll two setpoint levels for respective comparison with said actual value position signal and respectively corresponding to a lifting of said pressure roll away from said coil and to the application of coiling pressure by said roll to said coil in accordance with the position of said edge relative to said roll to prevent damage to the strip by application of roll pressure in a region of said edge, whereby said setpoint value is varied in correspondence with the setpoint level applied to said second comparator.

3. The apparatus defined in claim 2, further comprising a limiter between said position controller and said first comparator for limiting said setpoint value applied to said first comparator to a predetermined magnitude.

4. The apparatus defined in claim 2, further comprising a rate limiter between said pressure controller and said valve for limiting the rate of displacement of said valve in response to said pressure controller.

* * * * *